US005211225A

United States Patent [19]

Grosch

[11] Patent Number: 5,211,225

[45] Date of Patent: May 18, 1993

[54] SUBMERSIBLE PUMP ADAPTER

[76] Inventor: Wayne A. Grosch, 231 Brookwood Dr., Dublin, Ga. 31021

[21] Appl. No.: 749,262

[22] Filed: Aug. 23, 1991

[51] Int. Cl.[5] ..... E21B 4/04

[52] U.S. Cl. ..... 166/66.4; 166/68; 166/107

[58] Field of Search ..... 166/65.1, 66.4, 68, 166/107, 53, 105, 380

[56] References Cited

U.S. PATENT DOCUMENTS 4,548,552 10/1985 Holm ..... 447/417

4,830,113 5/1989 Geyer ..... 166/369

*Primary Examiner*—Terry Lee Melius

*Assistant Examiner*—Roger J. Schoeppel

*Attorney, Agent, or Firm*—Zarley, McKee, Thomte, Voorhees & Sease

[57] ABSTRACT

An adapter is provided for a submersible pump so as to permit the electrical cable to the submersible pump to be extended upwardly through the pipe column, which supports the submersible pump, to the upper end of the well. The positioning of the pump electrical cable in the pipe column prevents the electrical cable from being pinched between the pipe column and the well casing.

6 Claims, 4 Drawing Sheets

SUBMERSIBLE PUMP ADAPTER

BACKGROUND OF THE INVENTION

Water wells normally consist of a well casing which extends downwardly from ground level to a source of water. A submersible pump is normally positioned at the lower end of the well casing and has a pipe column connected to the upper end thereof. In operation, the pump pumps water upwardly through the pipe column. Heretofore, electrical power was supplied to the submersible pump by means of an electrical cable extending downwardly into the well between the well casing and the pipe column. The electrical cable was frequently "pinched" between the pipe column and the well casing and after a period of time became worn and caused a "short" in the circuit supplying power to the submersible pump. The pinching of the electrical cable is due in great part to the fact that the wells are not perfectly vertically disposed which results in the pipe column not always being perfectly centered within the well casing.

When a short occurs in the electrical circuit for the pump, the entire pipe column must be pulled from the well to repair the electrical cable. Not only does such an operation take the well out of service but the same is costly and time-consuming.

It is therefore the principal object of the invention to provide a means for preventing the shorting of the electrical cable supplying power to a submersible pump.

A further object of the invention is to provide an adapter for a pipe column in a water well which permits the electrical cable extending from the submersible pump to be positioned in the interior of the pipe column to prevent wear of the electrical cable.

Yet another object of the invention is to provide an adapter nipple for positioning on the lower end of a water well pipe column to enable the pump electrical cable to extend therethrough while preventing water from passing therethrough.

These and other objects of the present invention will be apparent to those skilled in art.

SUMMARY OF THE INVENTION

An adapter is described for use with a submersible pump so that the electrical cable extending from the submersible pump may be brought to the surface through the interior of the pipe column rather than between the pipe column and the well casing. The submersible pump is positioned at the lower end of the pipe column extending downwardly through a well casing. An adapter nipple is provided on the lower end of the pipe column and is adapted to have the pump electrical cable extending therethrough. The adapter nipple includes means for preventing water from passing therethrough. The inner end of the adapter nipple includes an electrical connector means. The electrical cable extends upwardly through the interior of the pipe column and may either pass outwardly through the upper end of the pipe column or may pass outwardly therefrom by means of a second adapter nipple.

DESCRIPTION OF THE PREFERRED EMBODIMENT

Figure 1:
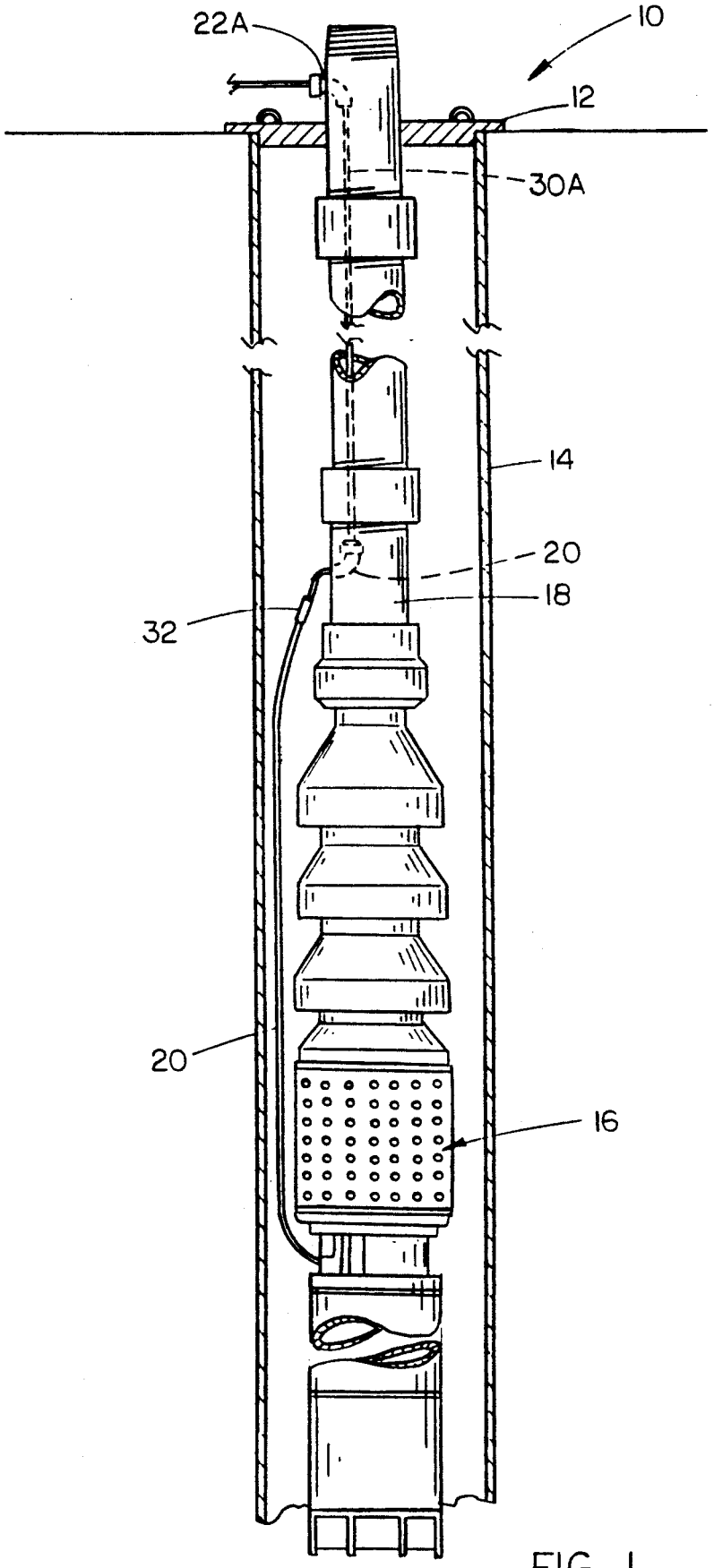
FIG. 1 is a sectional view of a typical water well having a submersible pump mounted therein and which illustrates the instant invention.

In FIG. 1, the numeral 10 refers generally to a conventional water well having a surface plate 12 at the upper end thereof. Well casing 14 extends downwardly into the ground to the water formation. The numeral 16 refers to a conventional submersible pump which is located in the bottom of the well and which is adapted to pump water from the casing 14 upwardly through column 18. Normally, column 18 is comprised of a plurality of links of pipes secured to the upper end of the pump 16 so that water may be pumped upwardly from the bottom of the well to the surface.

Heretofore, the electrical cable 20 which extends from the pump 16 extended to the surface between the pipe column 18 and the interior of the casing 14. In many cases, although the drawings do not so indicate, there is only a small space between the exterior of the pipe column and the interior surface of the casing 14. In those situations, the electrical cable 20 frequently became pinched or worn eventually resulting in a shorting of the cable 20 so that the pump 16 would be inoperative. Further, in many instances, the well is not perfectly vertically disposed which would cause the cable 20 to be pinched between the column 18 and the interior of the casing 14. To overcome the disadvantages of the prior art, the electrical cable 20 is extended upwardly through the interior of the pipe column 18 by means of an adapter nipple which is referred to generally by the reference numeral 22. Adapter nipple 22 consists of a short length of curved pipe which is welded to a short length of pipe 24 which is positioned between the upper end of the pipe 16 and the lowermost pipe section 18*a*.

Nipple 22 includes an electrical connector 26 at its inner end which is positioned in a rubber seal 28. Lead 30 is operatively connected to the connector 26 and extends downwardly and outwardly through the nipple 22 for connection to the upper end of the cable 20 at 32. Plug 34 is adapted to be connected to the connector 26. Plug 34 is positioned on the lower end of electrical cable 30*a* which extends upwardly through the interior of the pipe column to a source of electrical power.

Figure 2:
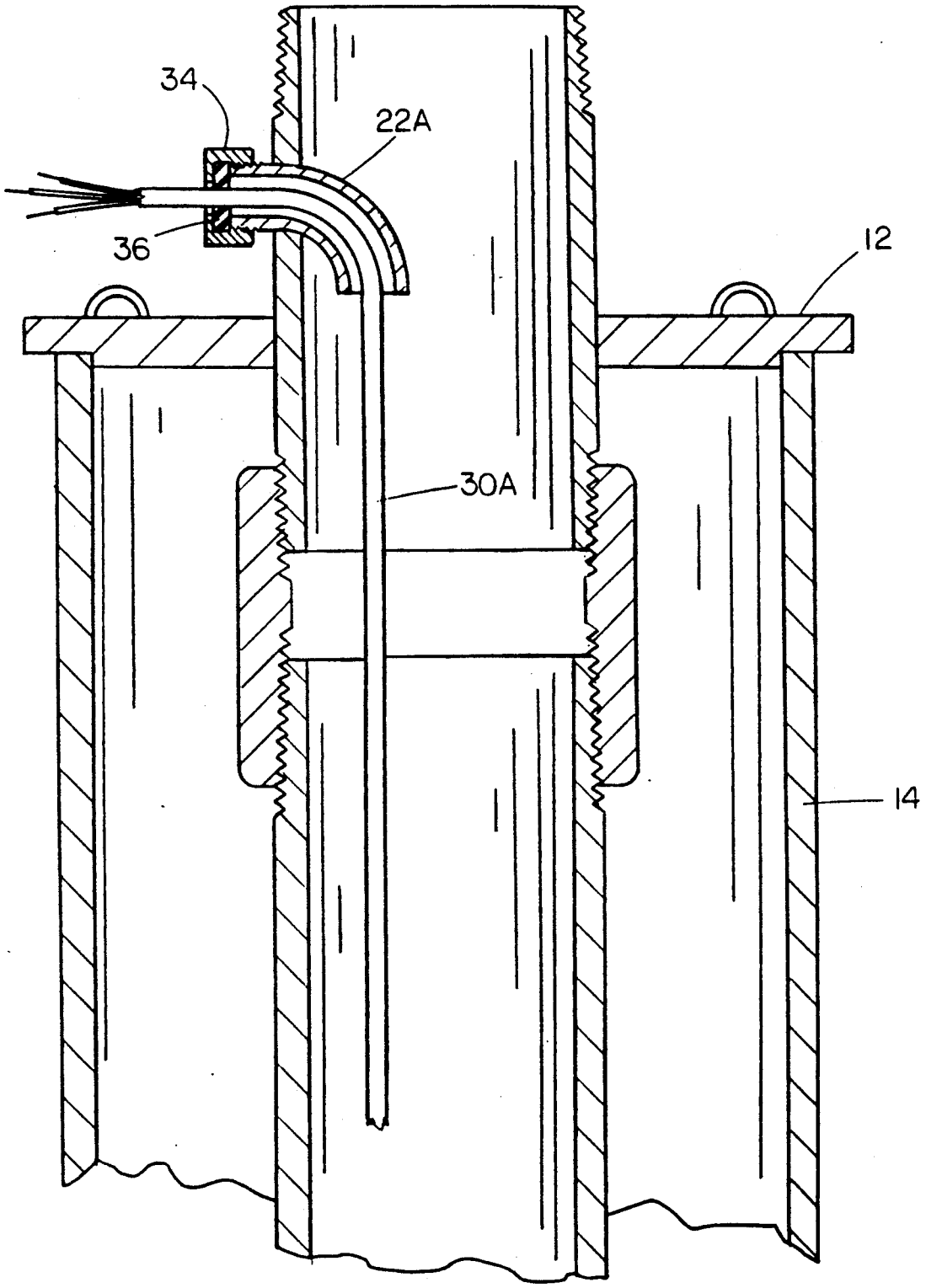
FIG. 2 is a sectional view of the upper portion of the pipe column.
Figure 3:
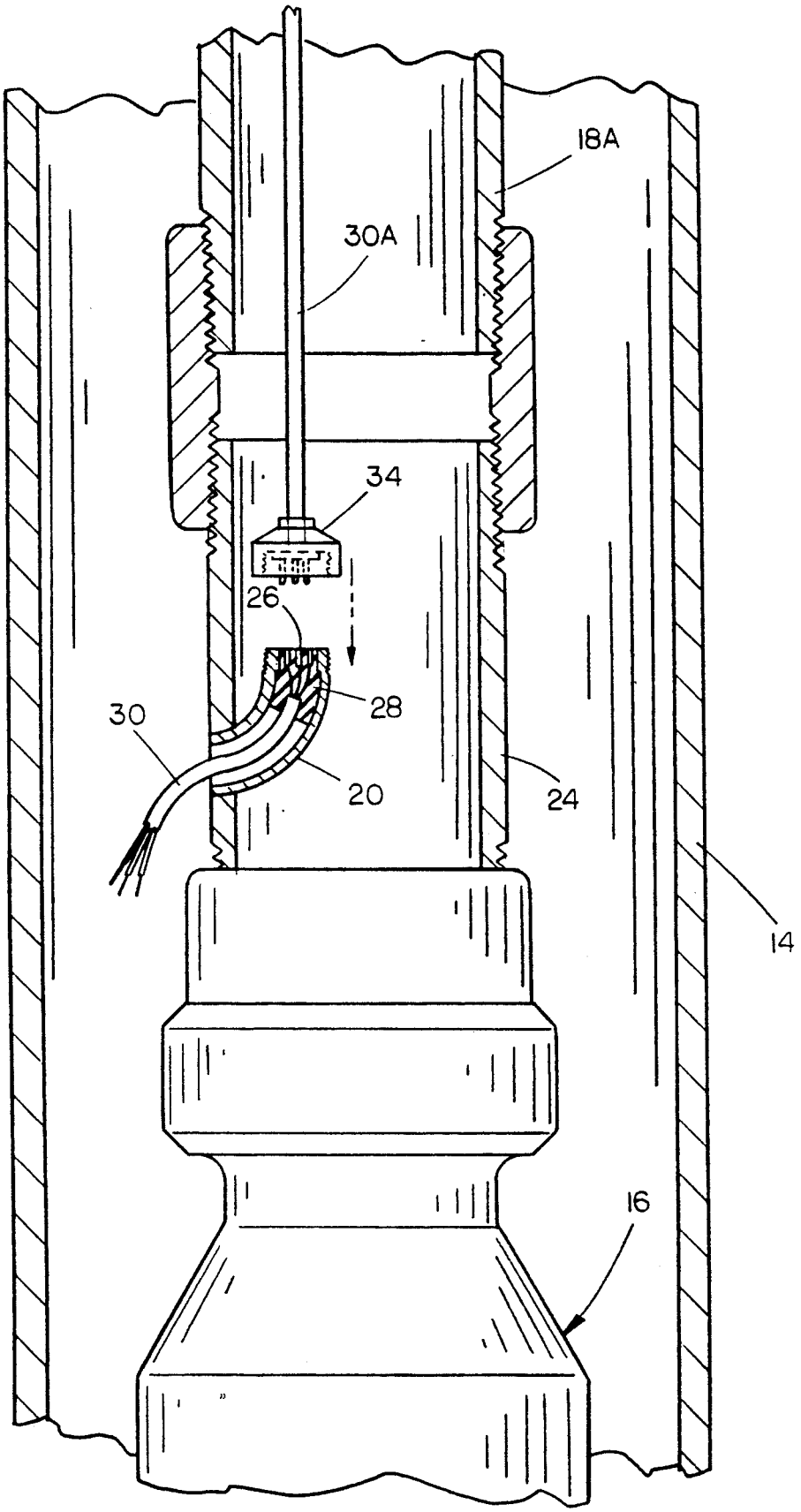
FIG. 3 is a sectional view of the lower end of the pipe column.
Figure 5:
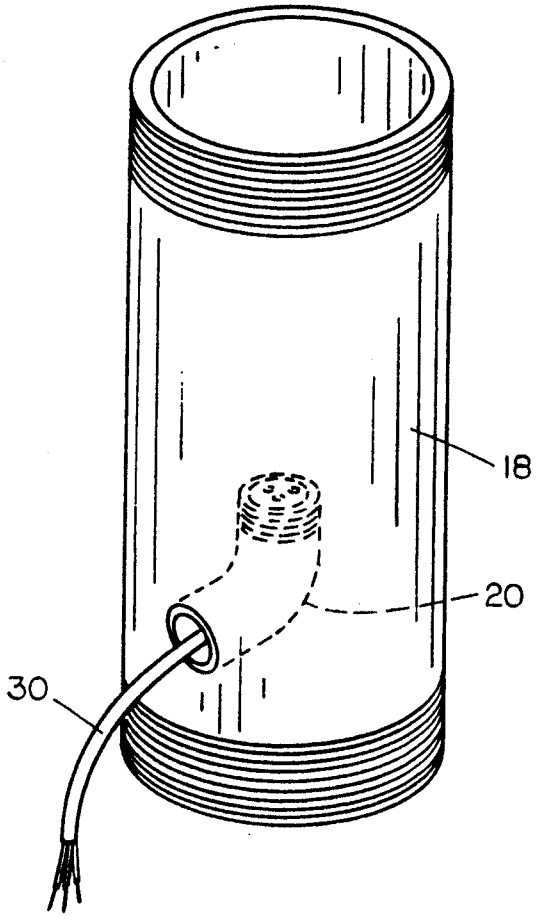
FIG. 5 is a prospective view of the lower end of the pipe column.
Figure 4:
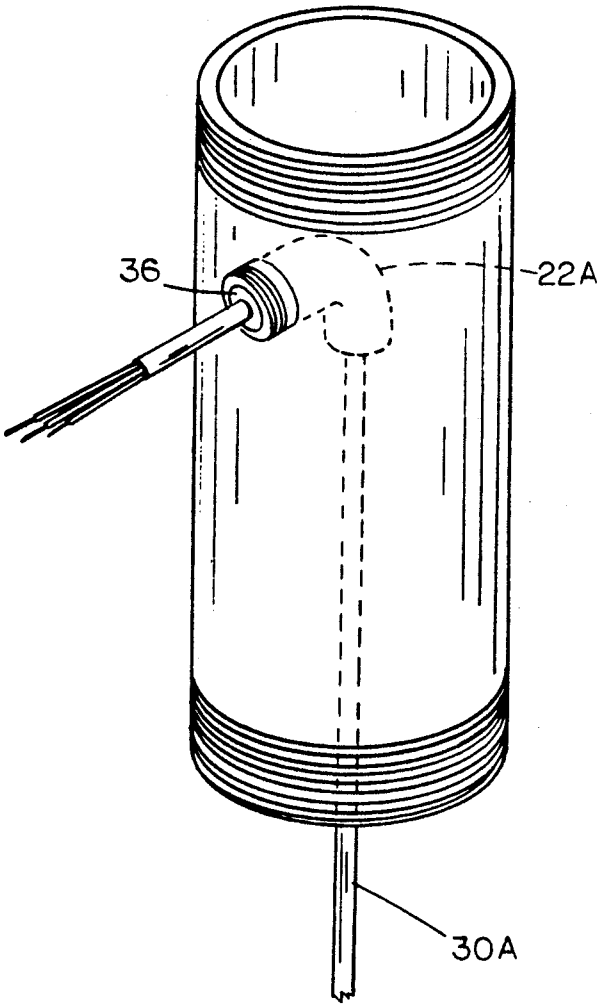
FIG. 4 is a prospective view of the upper end of the pipe column.

Although the upper end of the electrical cable of 30*a* could pass outwardly through the upper end of the pipe column 18, it is preferred that the cable 30*a* exit from the upper end of the pipe column through an adapter nipple 22*a* as seen in FIG. 2. Adapter nipple 22 includes a cap 34 and a seal 36 through which the cable 30*a* exits.

By positioning the cable 30*a* in the interior of pipe column 18, the cable is prevented from being pinched between the pipe column and the well casing so as to prevent shorting of the electrical cable. Thus it can be seen that the invention accomplishes at least all of its stated objectives.

I claim:

1. In combination, a water well including a vertically disposed casing extending downwardly into the ground, a vertically disposed pipe column positioned in said casing and having upper and lower ends, an electric submersible pump at the lower end of said pipe column for pumping water upwardly through said pipe column, said pump having an electrical cable extending therefrom, said electrical cable first extending upwardly from said pump between said pump and said casing, thence into the interior of said pipe column, and thence upwardly through said pipe column to a source of electrical power at the upper end of the well.

2. The combination of claim 1 wherein an adapter nipple means is provided on said pipe column at the lower end thereof, said electrical cable extending through said adapter nipple means into said pipe column, said adapter nipple means including means for preventing the flow of water therethrough.

3. The combination of claim 2 wherein said adapter nipple means includes an electrical connector means.

4. The combination of claim 2 wherein a second adapter nipple means is provided on said pipe column at the upper end thereof, said electrical cable extending outwardly from said pipe column through said second adapter nipple means.

5. The combination of claim 4 wherein said second adapter nipple means includes means for preventing the flow of water therethrough.

6. The combination of claim 5 wherein said second adapter nipple means includes an electrical connector means.

* * * * *